US008020963B2

(12) United States Patent
Yamamoto et al.

(10) Patent No.: US 8,020,963 B2
(45) Date of Patent: Sep. 20, 2011

(54) WIPING UNIT AND INKJET PRINTER

(75) Inventors: Hirotaka Yamamoto, Chiba (JP); Naoki Matsuya, Chiba (JP)

(73) Assignee: Seiko I Infotech Inc. (JP)

( * ) Notice: Subject to any disclaimer, the term of this patent is extended or adjusted under 35 U.S.C. 154(b) by 480 days.

(21) Appl. No.: 12/291,615

(22) Filed: Nov. 12, 2008

(65) Prior Publication Data

US 2009/0122105 A1 May 14, 2009

(30) Foreign Application Priority Data

Nov. 14, 2007 (JP) ..... 2007-295616

(51) Int. Cl.
*B41J 2/165* (2006.01)

(52) U.S. Cl. ..... 347/33

(58) Field of Classification Search ..... 347/21–22, 347/28, 30–36
See application file for complete search history.

(56) References Cited

U.S. PATENT DOCUMENTS 6,257,697 B1 7/2001 Kurata ..... 347/33

FOREIGN PATENT DOCUMENTS

| | | |
|---|---|---|
| DE | 19749670 | 5/1998 |
| EP | 0494693 | 7/1992 |
| EP | 0911170 | 4/1999 |

*Primary Examiner* — Julian D Huffman
*Assistant Examiner* — Tracey McMillion
(74) *Attorney, Agent, or Firm* — Adams & Wilks

(57) ABSTRACT

Provided is a wiping unit capable of reliably removing contamination of ink or the like adhering to a wiping blade after being wiped in spite of a simple configuration. Provided is a wiping unit having a wiping blade that performs wiping cleaning with respect to a recording head, including a first cleaning portion that cleans the wiping blade after performing the wiping cleaning, a second cleaning portion that performs secondary cleaning after passing through the first cleaning portion, and a blade transport portion that allows the wiping blade to move between the recording head, and the first cleaning portion and the second cleaning portion, in which the first cleaning portion and the second cleaning portion respectively include a cleaning tank which is filled with a detergent and in which the wiping blade is soaked in the detergent, and a blade wiping portion having a blade wiping member containing the detergent, which wipes a surface of the wiping blade having passed through the cleaning tank.

8 Claims, 6 Drawing Sheets

WIPING UNIT AND INKJET PRINTER

BACKGROUND OF THE INVENTION

1. Field of the Invention

The present invention relates to a wiping unit that performs wiping cleaning with respect to a recording head of an inkjet printer or the like, and an inkjet printer equipped with the wiping unit.

2. Related Background Art

A mechanism for maintaining the performance of a recording head that injects ink is indispensable for an inkjet printer, and is provided in most of the models. Among them, a nozzle cleaning mechanism that cleans a nozzle line surface (nozzle plate) of a recording head is important because, when ink droplets remain on the nozzle plate, or dust or the like adheres thereto, ink droplets to be injected are curved or ink cannot be injected from the nozzle, which has a serious effect on an image quality and the formation of an image.

A typical example of the nozzle cleaning mechanism includes a mechanism having a configuration of wiping a nozzle plate with a wiping blade (hereinafter, simply referred to as a "blade"). However, when contamination of ink or the like adhering to the blade after being wiped is left, the remaining ink is pushed in the nozzle due to the pressure acting on the blade, which causes inconvenience such as the destruction of meniscus of ink and clogging of the nozzle.

In order to solve the above problem, according to the JP 2002-79681 A, there is known a nozzle cleaner, which vibrates a blade, from which ink adhering to a nozzle plate has been wiped, when the blade moves to an ink removal portion to remove ink and dust adhering to the surface of the blade.

However, even with the nozzle cleaner described in Patent Document 1, it is actually difficult to remove the entire contamination of ink or the like adhering to a blade with one cleaning operation. In a nozzle cleaning mechanism, a configuration of wiping the surface of a blade with a sponge or the like after soaking the wiped blade in a detergent to make it easy to clean the blade and to remove the contamination on the surface thereof is known. There is a problem with such a configuration that, it is difficult to remove the entire contamination as described above, and hence a great amount of contamination adheres to and is accumulated on the surface of a sponge or the like with which wiping is performed to contaminate the blade again in some cases.

Particularly, in a so-called wide format inkjet printer having a print width exceeding 50 inches, a printing operation with a recording head is performed continuously 10 meters or more, and in this case, the amount of contamination of a nozzle plate increases. Thus, the possibility of the occurrence of the above-mentioned problem increases further.

Further, the nozzle cleaner of Patent Document 1 requires a mechanism for vibrating a blade, and hence an apparatus configuration becomes complicated and a production cost increases.

The present invention has been made in view of the above circumstance, and its object is to provide a wiping unit capable of reliably removing contamination of ink or the like adhering to a blade after wiping in spite of a simple configuration, and an inkjet printer.

SUMMARY OF THE INVENTION

According to a first aspect of the present invention, there is provided a wiping unit having a wiping blade for performing wiping cleaning with respect to a recording head of an inkjet printer, including: a first cleaning portion for cleaning the wiping blade after performing the wiping cleaning; a second cleaning portion for performing secondary cleaning of the wiping blade after passing through the first cleaning portion; and a transport mechanism for allowing the wiping blade to reciprocate between the recording head, and the first cleaning portion and the second cleaning portion, in which the first cleaning portion and the second cleaning portion each include: a cleaning tank which is filled with a detergent and in which the wiping blade is soaked in the detergent; and a blade wiping portion having a blade wiping member containing the detergent, for wiping a surface of the wiping blade having passed through the cleaning tank.

According to the wiping unit of the present invention, the wiping blade after the wiping cleaning is cleaned in the first cleaning portion having the cleaning tank and the blade wiping portion, and secondarily cleaned in the second cleaning portion having the cleaning tank and the blade wiping portion, whereby contamination is removed reliably.

At least one of the first cleaning portion and the second cleaning portion may further include a removing portion which is provided between the cleaning tank and the blade wiping portion, and comes into contact with the wiping blade having passed through the cleaning tank to remove contamination on the surface of the wiping blade. In this case, a part of contamination is removed from the surface of the wiping blade by the removing portion before the wiping blade comes into contact with the blade wiping portion, and hence the amount of contamination adhering to the blade wiping portion can be reduced.

The wiping unit of the present invention may further include a final cleaning tank which is filled with the detergent and in which the wiping blade having passed through the second cleaning portion is soaked in the detergent. In this case, contamination can be removed reliably in the final cleaning tank, and the wiping blade can be made wet appropriately to prevent the recording head from being dried.

The time during which the wiping blade is soaked in the detergent in the second cleaning portion may be set to be longer than the time during which the wiping blade is soaked in the detergent in the first cleaning portion. Further, the distance by which the wiping blade moves in the cleaning tank in the second cleaning portion may be set to be longer than the distance by which the wiping blade moves in the cleaning tank in the first cleaning portion.

In those cases, both surfaces of the wiping blade are sufficiently soaked in the detergent, and hence both the surfaces of the blade can be cleaned satisfactorily.

In the first cleaning portion and the second cleaning portion, the blade wiping member may be placed so as to come into contact with the detergent filled in the cleaning tank. In this case, the state in which the blade wiping member absorbs the detergent at all times is maintained, and hence the extra effort of the operation for a user to make the blade wiping portion wet can be saved.

The cleaning tank of at least one of the first cleaning portion and the second cleaning portion may have ribs provided in a depth direction, and the ribs may have an index portion at a height of the liquid surface when the cleaning tank is filled with a required amount of the detergent. In this case, the strength of the cleaning tank increases, and the detergent can be supplemented preferably based on the index portion.

According to a second aspect of the present invention, there is provided an inkjet printer including the wiping unit of the present invention.

According to the inkjet printer of the present invention, an inkjet printer with a simple configuration, in which the contamination of a recording head can be removed reliably, can be provided.

According to the wiping unit and the inkjet printer of the present invention, contamination of ink or the like adhering to a blade after wiping can be removed reliably in spite of a simple configuration.

DETAILED DESCRIPTION OF THE PREFERRED EMBODIMENTS

Hereinafter, a wiping unit and an inkjet printer in one embodiment of the present invention are described with reference to FIGS. 1 to 6.

Figure 1:
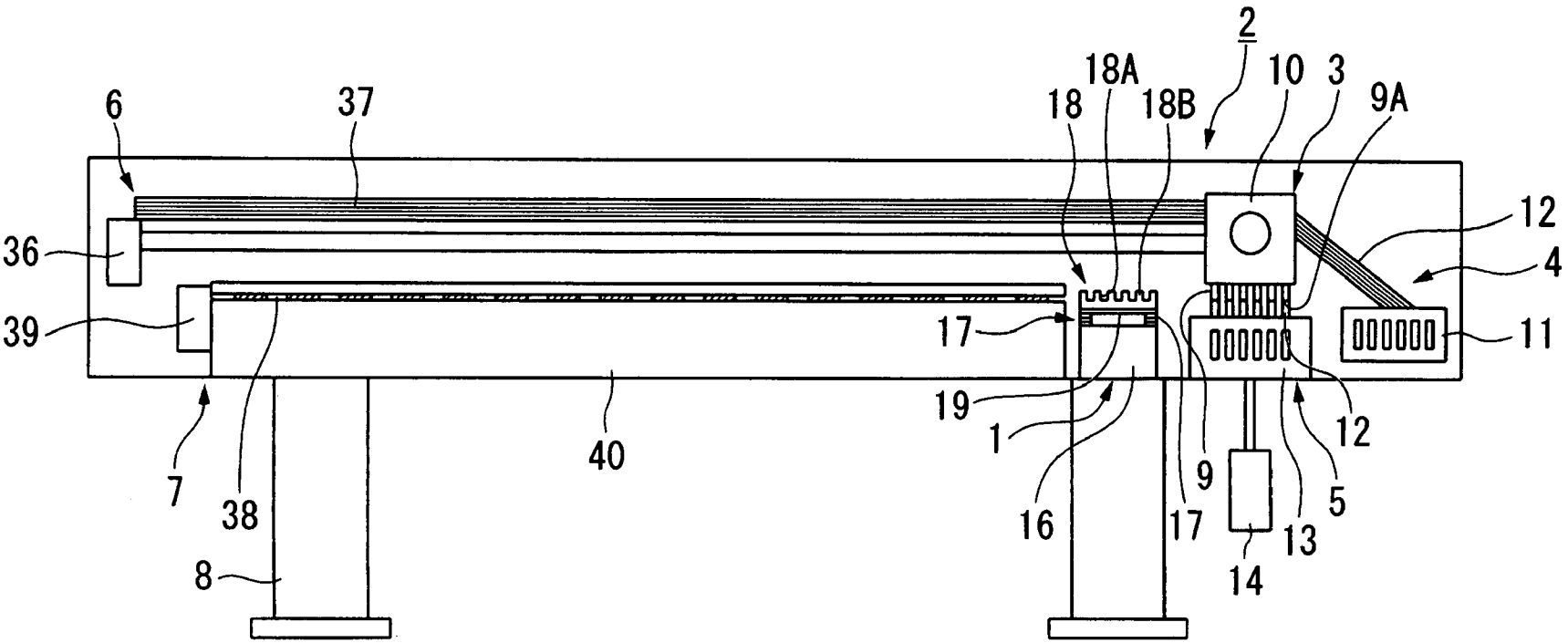
FIG. 1 is a view showing a configuration of an inkjet printer having a wiping unit of one embodiment of the present invention.

FIG. 1 is a view showing a configuration of an inkjet printer 2 having a wiping unit 1 of the present embodiment. The inkjet printer 2 is a wide format printer, and includes a head portion 3 that performs printing, an ink supply portion 4 that supplies ink to the head portion 3, a capping portion 5 that performs maintenance on the head portion 3, a wiping unit 1 that cleans the head portion 3, a head transport portion 6 that moves the head portion 3, a paper transport portion 7 that transports paper to be printed, and a leg portion 8 that supports each mechanism.

The head portion 3 includes a plurality of recording heads 9 and a carriage 10 to which the recording heads 9 are attached. The recording heads 9 respectively correspond to ink of different colors, and in the present embodiment, six recording heads 9 are attached to the carriage 10. The recording heads 9 are placed under a condition that nozzle plates 9A with a number of minute nozzles are opened are directed downward, and perform a printing operation by discharging liquid droplets of ink toward paper on the paper transport portion 7 side while moving along the head transport portion 6 together with the carriage 10.

The ink supply portion 4 includes an exchangeable ink cartridge 11 and a plurality of ink tubes 12. The ink cartridge is filled with ink of 6 colors, and each ink is supplied to the nozzle of the corresponding recording head 9 via the ink tube 12.

The capping portion 5 includes a plurality of caps 12 that come into contact with each recording head 9 attachably/detachably to seal each nozzle plate 9A, and a suction pump 13 for sucking air bubbles and ink from the nozzles in the recording heads 9.

The caps function as receiving plates for ink sucked from the nozzles, and come into contact with the recording heads 9 to prevent the nozzle plates 9A from being dried when the ink jet printer 2 is not used.

The suction pump 13 sucks old ink, minute air bubbles, and the like from inside the nozzles, thereby performing maintenance on the head portion 3 and arrange meniscus of ink to stabilize the printing by the head portion 3. Ink and the like sucked by the suction pump 13 are reserved in a wastewater bottle 14 provided in a lower portion.

Figure 2:
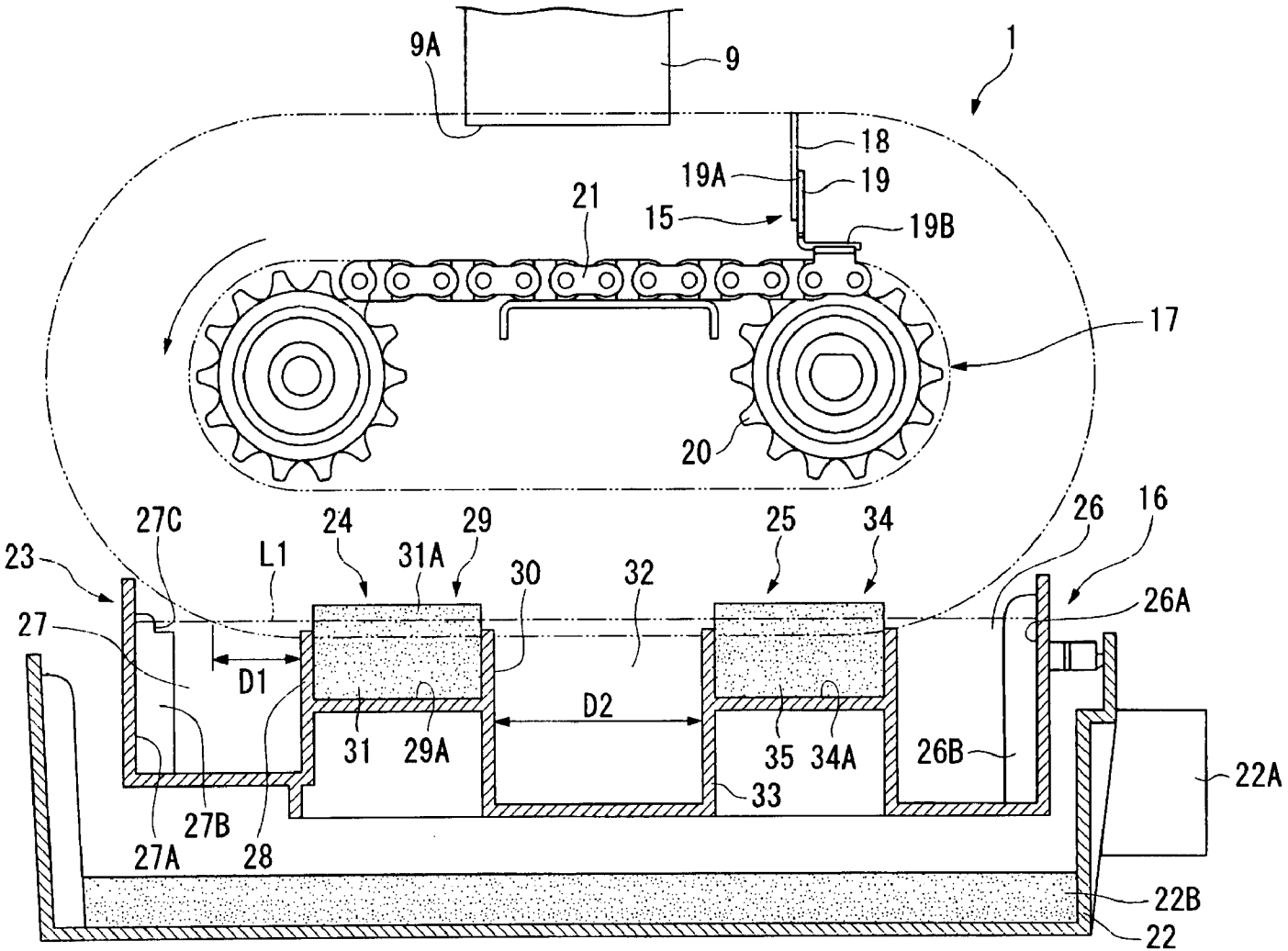
FIG. 2 is a view showing a configuration of the wiping unit.

FIG. 2 is a view showing a configuration of the wiping unit 1. As shown in FIGS. 1 and 2, the wiping unit 1 includes a blade portion 15 that wipes the nozzle plates 9A of the recording heads 9, a cleaning portion 16 that cleans the blade portion 15, and blade transport portions (transport mechanisms) 17 that allow the blade portion 15 to reciprocate between the nozzle plates 9A and the cleaning portion 16.

The blade portion 15 includes a blade 18 that comes into contact with the nozzle plates 9A to remove contamination and the like, and a fixing member 19 attached to the blade transport portions 17.

The blade 18 is formed of rubber or the like. Then, as shown in FIG. 1, a plurality of notches 18A are provided on the side of the recording heads 3 to form six tongue chips 18B, and the tongue chips 18B respectively correspond to six recording heads 9.

The fixing member 19 is made of a plate or the like, and the blade is thermally welded to one end portion 19A thereof. Then, the other end portion 19B thereof is fixed to the blade transport portions 17.

As shown in FIG. 2, the blade transport portion 17 includes sprockets 20 and a chain 21 wound around the sprockets 20. In FIG. 2, for ease of viewing, a part of the chains 21 is omitted.

As shown in FIG. 1, two sets of the blade transport portions 17 are placed in the vicinity of both ends in a longitudinal direction of the blade 18 and between the blade portion 15 and the cleaning portion 16 described later, and the fixing member 19 of the blade portion 15 is attached across two chains 21.

The chain 21 rotates in a direction indicated by an arrow shown in FIG. 2 along with the rotation of the sprockets 20 by a rotation mechanism such as a motor (not shown), and allows the blade portion 15 attached to the chain 21 to reciprocate between the nozzle plates 9A and the cleaning portion 16.

Figure 3:
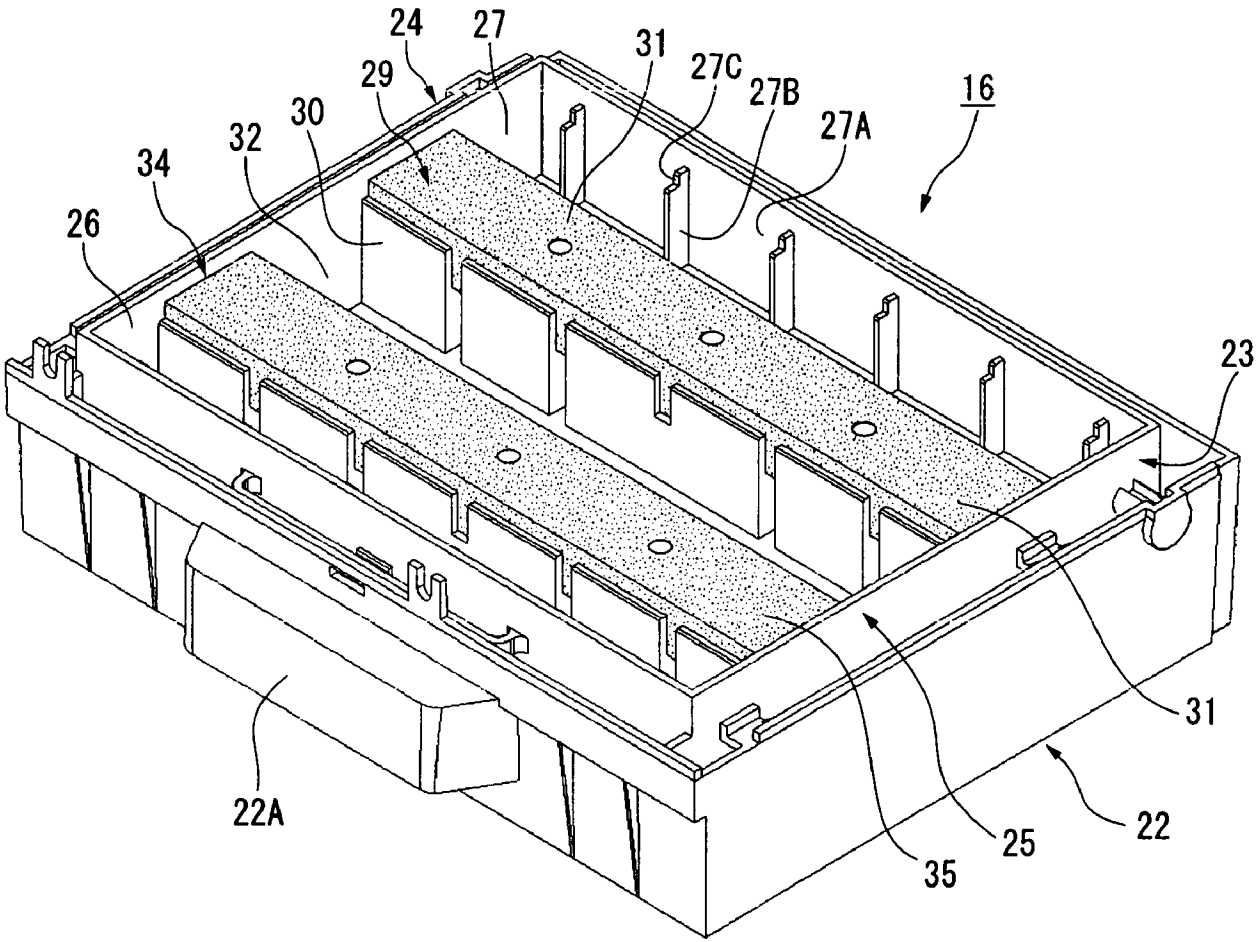
FIG. 3 is a perspective view showing a cleaning portion of the wiping unit.
Figure 4:
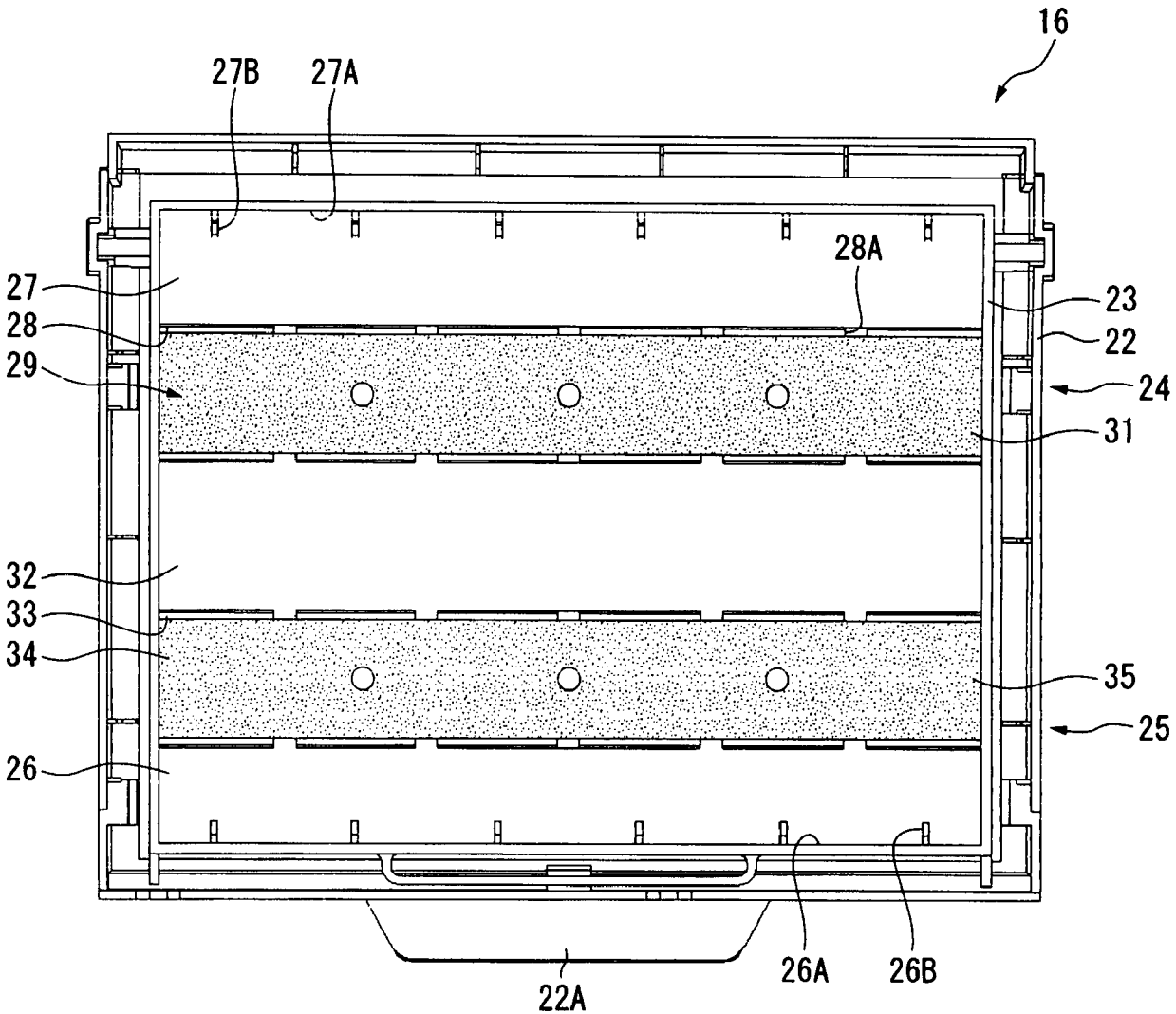
FIG. 4 is a plan view of the cleaning portion.

FIG. 3 is a perspective view of the cleaning portion 16, and FIG. 4 is a plan view of the cleaning portion 16. As shown in FIGS. 3 and 4, the cleaning portion 16 includes a first container 22 covering the outside, and a second container 23 which is placed in the first container and in which the blade 18 is cleaned. The first container 22 and the second container 23 can be both formed of a resin or the like.

The first container 22 is formed so as to be one size larger than that of the second container 23, and the second container is accommodated in the first container 22. Further, the first container 22 is provided with a holding portion 22A for holding the cleaning portion 16 when the cleaning portion 16 is attached/detached with respect to the inkjet printer 2. Further, as shown in FIG. 2, an absorbing member 22B made of sponge or the like is attached to a bottom surface inside the first container 22 so as to absorb a detergent spilling from the second container 23.

The second container 23 includes a first cleaning portion 24 that cleans the blade 18 immediately after wiping the recording heads 9, a second cleaning portion 25 that performs secondary cleaning after the blade 18 is cleaned in the first cleaning portion 24, and a final cleaning tank 26 in which the blade 18 having passed through the second cleaning portion 25 is soaked in the detergent.

The first cleaning portion 24 includes a first cleaning tank 27 provided on an upstream side in a movement direction of the blade portion 15, a first wall surface (removal portion) 28 provided so as to protrude on a downstream side of the first cleaning tank 27, and a first blade wiping portion 29 placed on a downstream side of the first wall surface 28.

The first cleaning tank 27 is filled with a detergent up to a height of a liquid surface line L1 indicated by a chain double-dashed line in FIG. 2. Thus, the tip end of the blade 18 indicated by a broken line is soaked in the detergent when the blade 18 is moved by the blade transport portion 17.

Further, on an inner wall 27A on an upstream side of the first cleaning tank 27 forming a part of the sidewall of the second container 23, a plurality of ribs 27B for increasing the strength are provided in a depth direction. The ribs 27B are provided with a level difference (index portions) 27C in the vicinity of the liquid surface line L1, which functions as an index for supplementing the detergent in the second container 23 at a time of maintenance.

In the detergent filled in the first cleaning tank 27, the solubility of a solvent contained in ink preferably has predetermined performance or more in terms of the cleaning property, and the volatility is preferably suppressed to be a predetermined level or lower so that the liquid surface in the first cleaning tank 27 is difficult to be lowered in terms of the maintenance. Generally, the volatility of the detergent tends to increase along with the increase in solubility. Therefore, it is preferred to produce a detergent with the solubility and the volatility well balanced by mixing a detergent with a high solubility with a detergent with a low volatility and to fill the first cleaning tank 27 with the resultant detergent.

The first wall surface 28 is provided so as to be substantially parallel to the moving blade 18. A plurality of notches 28A are provided at an upper end of the first wall surface 28, and divided upper portions of the first wall surface 28 are formed so as to correspond to the tongue chips 18B of the blade 18, respectively.

Figure 5:
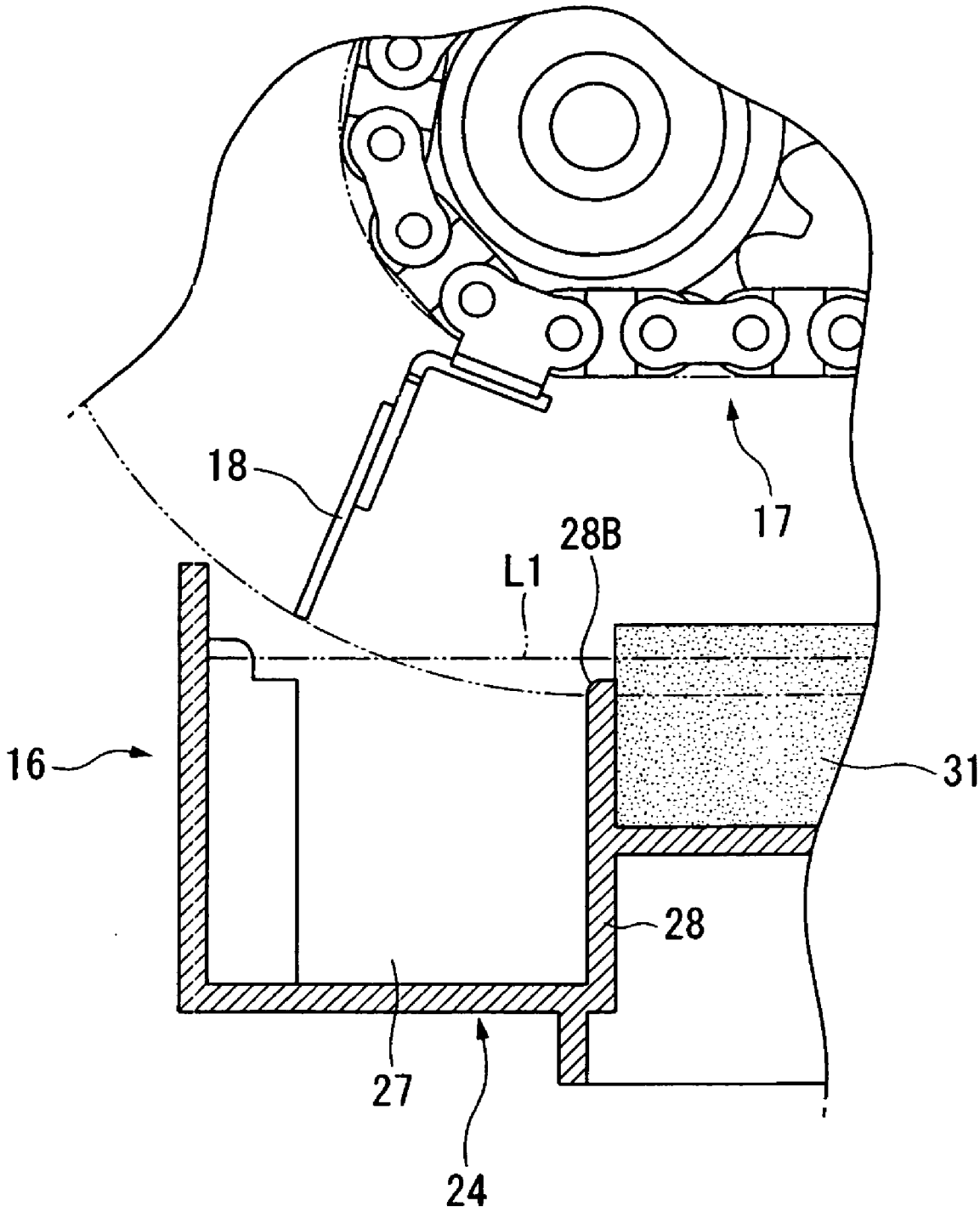
FIG. 5 is an enlarged view of the vicinity of a first cleaning portion of the cleaning portion.

Further, an upper end corner 28B of the side of the first wall surface 28 opposed to the blade 18 is chamfered to be a curved shape so as not to damage the surface of the blade 18 with which the upper end corner 28B comes into contact, as shown in FIG. 5 in an enlarged state.

The first blade wiping portion 29 is configured so that a first wiping member (blade wiping member) 31 for wiping the surface of the blade 18 is fixed to a first support surface 29A provided between the first wall surface 28 and a first support wall surface 30 protruding on a downstream side of the first wall surface 28.

The first wiping member 31 is made of sponge or the like, and is always in contact with the detergent filled in the first container to maintain a wet state containing a sufficient amount of detergent therein. As shown in FIG. 2, the thickness of the first wiping member 31 is set so that an upper surface 31A thereof is placed at a position higher than the upper ends of the first wall surface 28 and the first support wall surface 30, and the liquid surface line L1 of the detergent.

The second cleaning portion 25 is provided on a downstream side of the first cleaning portion 24, and has substantially the same configuration as that of the first cleaning portion 24, including a second cleaning tank 32, a second wall surface 33, and a second blade wiping portion 34.

Here, a dimension D2 in the movement direction of the blade portion 15 of the second cleaning tank 32 is preferably set to be larger than a dimension D1 in the movement direction of the blade portion 15 in a region where the tip end of the blade 18 is soaked in the detergent in the first cleaning tank 27.

In the present embodiment, due to the above configuration, the distance by which the blade 18 moves while being soaked in the detergent is longer in the second cleaning tank 32 than in the first cleaning tank 27, and the blade 18 is soaked in the detergent in the second cleaning tank 32 for a longer period of time.

The final cleaning tank 26 is provided on a further downstream side of the second cleaning portion 25, and is filled with a detergent. An inner wall 26A on a downstream side of the final cleaning tank 26 forming a part of the side wall of the second container 23 is also provided with a plurality of ribs 26B for increasing strength in a depth direction. The ribs 26B having index portions to be an index for supplementing a detergent may be used in the same way as in the ribs 27B of the first cleaning tank 27.

As shown in FIG. 3, the first cleaning tank 27, the second cleaning tank 32, and the final cleaning tank 26 are communicated with each other in a lower part of the first blade wiping portion 29 and the second blade wiping portion 34. Thus, the total capacity of three cleaning tanks is increased to decrease the frequency of supplementing a detergent, and the heights of liquid surfaces of all the cleaning tanks are set to be identical at all times.

Further, in the part of the first blade wiping portion 29 and the second blade wiping portion 34 where the cleaning tanks are communicated with each other, the first support surface 29A and the second support surface 34A are not provided, and the first wiping member 31 and the second wiping member 35 are directly in contact with the detergent. Thus, the contact area between the respective wiping members 31, 35 and the detergent is increased so that the respective wiping members 31, 35 easily absorb the detergent.

Returning to FIG. 1, the head transport portion 6 has a known configuration, and moves the head portion 3 along a carriage rail 37 with a movement mechanism 36 such as a motor.

The paper transport portion 7 includes a roller portion 38 having a pinch roller, a grid roller, and the like for sending paper, a rotation mechanism 39 such as a motor that rotates the roller portion 38, and a platen 40 that supports paper, and has a known configuration in the same way as in the head transport portion 6.

The operation during cleaning of the head portion 3 in the inkjet printer 2 configured as described above is described below.

First, the head portion 3 moves along the carriage rail 37 by the movement mechanism 36, and the recording heads 9 move to a position opposed to the wiping unit 1 and stop. At this time, as shown in FIG. 2, the recording heads 9 move such that the nozzle plates 9A are positioned inside a contour of the movement of the blade 18 indicated by a broken line.

Then, the sprockets 20 of the blade transport portion 17 rotate, and the blade portion 15 attached to the chains 21 move toward the recording heads 9. The respective tongue chips 18B of the blade 18 come into contact with the nozzle plates 9A of the corresponding recording heads 9. The tip end of the blade 18 is curved and moves while rubbing against the surfaces of the nozzle plates 9A, thereby wiping the recording heads 9.

At this time, the chains 21 rotate at a constant speed. Further, since a plurality of tongue chips 18B are formed of a plurality of notches 18A, the flexibility of the tip end of the blade 18 increases, and the tip end of the blade 18 comes into contact even with the nozzle plates 9A of the recording heads 9 placed on different levels without getting twisted, thereby cleaning the recording heads 9.

The blade 18 after wiping cleaning moves toward the cleaning portion 16 by the blade transport portion 17. Then, as shown in FIG. 5, the blade 18 first moves to the first cleaning tank 27 of the first cleaning portion 24, and the tip end of the blade 18 to which contamination of ink or the like adheres due to the wiping cleaning moves below the liquid surface line L1 and is soaked in the detergent. Thus, the contamination that comes off relatively easily is removed, and the contamination becomes easy to come off in the following steps.

After that, the blade 18 comes into contact with the first wall surface 28, and contamination of solidified ink or the like is removed from the surface of the blade 18. Thus, the amount of contamination that adheres to the first wiping member 31 is reduced, and the tip end of the blade 18 is bent to be deformed so as to come into contact with the first wiping member 31 more satisfactorily.

At this time, the tip ends of the tongue chips 18B come into contact with the first wiping member 31 while being soaked in the detergent, and hence contamination easily comes off. Further, since the side surface portion of the first wiping member 31 with which the tip ends of the tongue chips 18B come into contact are soaked in the detergent, the contamination adhering to the side surface portion is also dissolved in the detergent, whereby the contamination can be prevented from being solidified to adhere. Further, since the tip ends of the tongue chips 18B are once bent by the first wall surface 28, the tip ends of the tongue chips 18B come into contact with the first wiping member 31 satisfactorily, with the help of the reaction obtained when the bent returns while the tip ends leave the first wall surface 28.

Figure 6:
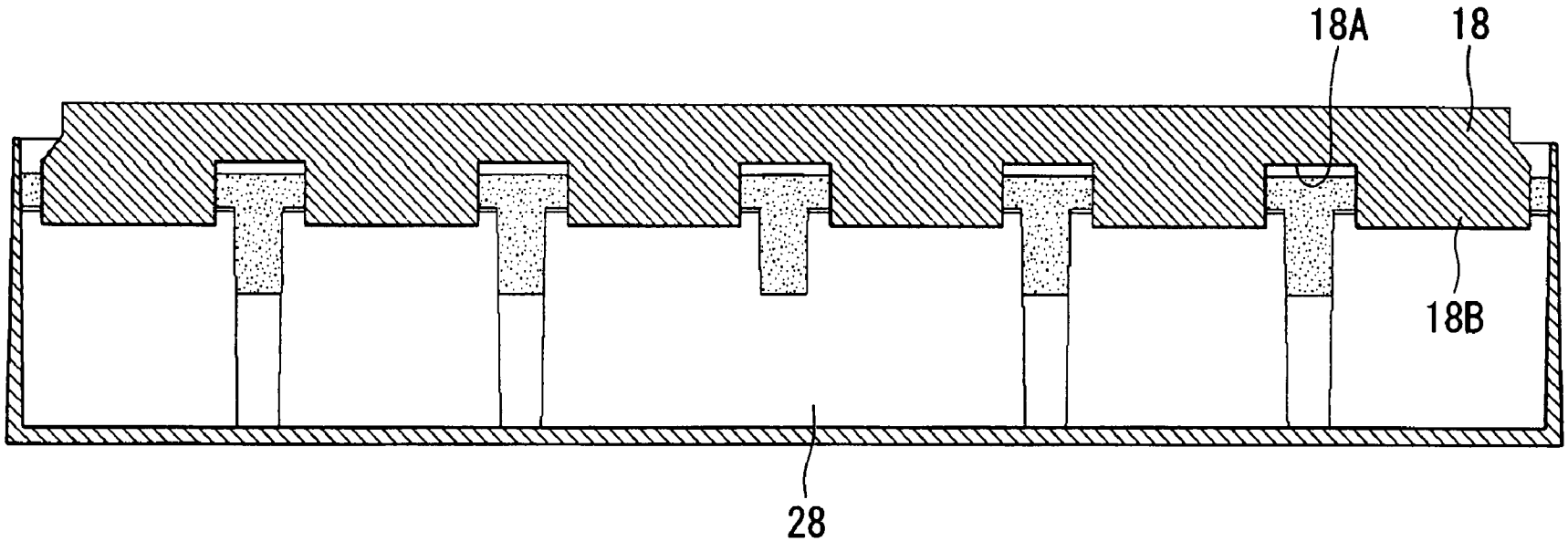
FIG. 6 is a view showing a contact state between a blade and a first wall surface of the wiping unit.

At this time, as shown in FIG. 6, the tongue chips 18B at the tip ends of the blade 18 come into contact with the divided upper portions of the first wall surface 28, respectively, and hence the contamination of ink of different colors does not adhere to the same tongue chip 18B. Further, a corner 28B of the first wall surface 28 is formed in a curved shape, and hence the surface of the blade 18 is not damaged. Further, each width of the divided upper portion of the first wall surface 28 is set to be larger than the width of the tongue chip 18B, and hence the entire tip ends of the tongue chips 18B come into contact with the upper portions of the first wall surface 28, and the contamination is removed over the entire width of each tongue chip 18B.

Further, the blade 18 comes into contact with the first wiping member 31, and wiping cleaning of the surface of the blade 18 is performed along with the movement of the blade 18. The contamination of ink having moved from the surface of the blade 18 to the first wiping member 31 is diffused in the detergent successively when the solvent contained in ink is dissolved in the detergent absorbed by the first wiping member 31. Thus, primary cleaning of the blade 18 is performed by the first cleaning portion 24.

The blade 18 whose primary cleaning has been completed is moved to the second cleaning portion 25 by the blade transport portion 17, and the secondary cleaning of the blade 18 is performed in a procedure substantially similar to that of the primary cleaning in the first cleaning portion 24.

At this time, as described above, the dimension D2 of the second cleaning tank 32 is set to be larger than the dimension D1 in the first cleaning tank 27. Therefore, the tip end of the blade 18 is soaked in the detergent for a long period of time, and not only the surface opposed to the second wall surface 33 but also the surface on an opposite side are cleaned satisfactorily. After that, the blade 18 passes through the second wall surface 33 and the second blade wiping portion 34, whereby the secondary cleaning of the blade 18 is completed.

The blade 18 is finally soaked in the detergent in the final cleaning tank 26 for a short period of time. As a result, the detergent appropriately adheres to the tip end of the blade 18 simultaneously when the finish cleaning is performed, whereby the nozzle plates 9A of the recording heads 9 are made wet appropriately during the subsequent cleaning. Consequently, in the following step, the nozzle plates 9A are sealed satisfactorily by the capping portion 5.

In the wiping unit 1 of the present embodiment, the blade 18 after performing wiping cleaning of the recording heads 9 is cleaned by the first cleaning portion 24 having the first cleaning tank 27, the first wall surface 28, and the first blade wiping portion 29, and further, the secondary cleaning of the blade 18 is performed by the second cleaning portion 25 having the second cleaning tank 32, the second wall surface 33, and the second blade wiping portion 34. Thus, even when the blade 18 is not vibrated, contamination adhering to the surface of the blade 18 can be removed reliably.

Further, the blade 18 is cleaned by the second cleaning portion 25 immediately after being cleaned by the first cleaning portion 24, and thus, the blade 18 is cleaned twice continuously. As a result, the contamination that has not been removed by the first cleaning portion 24 is cleaned continuously without providing a drying time, and hence the contamination easily comes off.

Further, the respective wiping members 31, 35 attached to the respective blade wiping portions 29, 34 are placed so as to be in contact with the detergent filled in the second container 23 of the cleaning portion 16 at all times. Therefore, the wiping members 31, 35 are wet at all times, containing the detergent inside. This makes it unnecessary to perform an operation, for example, in which the user drops the detergent onto the wiping members to wet them. Consequently, the head portion 3 can be cleaned with the labor of the user reduced further.

Further, the blade 18 can be cleaned sufficiently merely by moving the blade portion 15 in one direction, and hence it is not necessary to provide a mechanism for vibrating the blade 18 and moving it in an opposite direction in the blade transport portion 17. Thus, the configuration of the blade transport portion 17 can be simplified.

In addition, the blade 18 is soaked in the detergent in the final cleaning tank 26 after the completion of the secondary cleaning. Therefore, the nozzle plates 9A and the nozzles of the recording heads 9 can be prevented from being dried, and the printing by the recording heads 9 can be stabilized.

Further, the first cleaning tank 27, the second cleaning tank 32, and the final cleaning tank 26 are communicated with each other, and the ribs 27B provided on the inner wall 27A of the first cleaning tank 27 are provided with a level difference 27C to be an index for filing the detergent. Thus, the detergent is supplemented or exchanged based on the level difference 27C, whereby the suppliance and the like of the detergent can be performed so that the heights of the liquid surfaces of all the cleaning tanks become satisfactory, and hence it is not necessary to adjust the liquid surface of each cleaning tank.

Further, by providing the ribs 27B with the level difference 27C, an index of a height of a liquid surface is not required to be provided separately. Further, since the index by the level difference 27C is stereoscopic, and hence it is easily recognized visually from an angle wider than that of a plane index. In addition, by providing a plurality of level differences, an index capable of recognizing the height of the liquid surface in more detail can also be obtained.

Further, the second container 23 of the cleaning portion 16 is accommodated in the first container 22 that is one size larger than that of the second container 23. Therefore, even when the detergent filled in the second container 23 spills due to the movement of the inkjet printer 1 or the like, the detergent is accommodated in the first container 22 to be absorbed by an absorbing member 22B, and hence the influence on the other members of the inkjet printer 1 can be suppressed.

One embodiment of the present invention has been described in the above. However, the technical range of the present invention is not limited to the above embodiment, and can be modified variously without departing from the spirit of the present invention.

For example, in the above embodiment, an example has been described in which, regarding the dimension in the proceeding direction of the blade portion 15, D2 of the second cleaning-tank 32 is set to be larger than D1 of the first cleaning tank 27, whereby the second blade 18 is soaked in the detergent longer in the cleaning tank 32. However, a method of prolonging a soaking time of the blade 18 in the second cleaning tank 32 is not limited thereto.

There is an example in which a stepping motor or the like is adopted as a mechanism for rotating the sprockets 20 of the blade transport portion 17 to decrease the movement speed of the blade portion 15 in the second cleaning tank 32, whereby the wiping unit 1 is configured so as to prolong the soaking time of the blade 18 in the second cleaning tank 32.

Further, it is desirable that the first wall surface 28 and the second wall surface 33 are present. However, in the case where the contamination of the blade 18 can be removed sufficiently by the first blade wiping portion 29 or the second blade wiping portion 34, the first wall surface 28 and the second wall surface 33 may not necessarily be provided or either one may be provided.

In those cases, in order to support each blade wiping portion, wall surfaces with heights which do not come into contact with the blade 18, i.e., which do not function as removing portions may be provided instead of the first wall surface 28 and the second wall surface 33, if required.

Further, the wiping unit of the present invention may be configured so as to include a plurality of the blades 18 by providing a plurality of blade portions 15 at the chains 21. According to this configuration, wiping cleaning of the recording heads 9 is performed a plurality of times during one rotation of the chains 21, and hence a cleaning time can be shortened when a plurality of wiping cleanings are performed with respect to tough contamination.

In addition, the final cleaning tank 26 is not essential in the present invention. For example, the cleaning portion 16 may be configured without providing the final cleaning tank 26 when the contamination of the recording heads 9 at an ordinary time is such a degree as to be removed sufficiently by the first and second cleaning portions.

Similarly, the first container 22 is not essential, either, and hence the cleaning portion 16 may be configured without providing the first container 22.

What is claimed is:

1. A wiping unit having a wiping blade for performing wiping cleaning with respect to a recording head of an inkjet printer, comprising:

a first cleaning portion for cleaning the wiping blade after performing the wiping cleaning;

a second cleaning portion for performing secondary cleaning of the wiping blade after passing through the first cleaning portion; and a transport mechanism for allowing the wiping blade to reciprocate between the recording head, and the first cleaning portion and the second cleaning portion, wherein the first cleaning portion and the second cleaning portion each include:

a cleaning tank which is filled with a detergent and in which the wiping blade is soaked in the detergent; and a blade wiping portion having a blade wiping member containing the detergent, for wiping a surface on the wiping blade having passed through the cleaning tank.

2. The wiping unit according to claim 1, wherein at least one of the first cleaning portion and the second cleaning portion further comprises a removal portion which is provided between the cleaning tank and the blade wiping portion, and comes into contact with the wiping blade having passed through the cleaning tank to remove contamination of the surface on the wiping blade.

3. The wiping unit according to claim 1, further comprising a final cleaning tank which is filled with the detergent and in which the wiping blade having passed through the second cleaning portion is soaked in the detergent.

4. The wiping unit according to claim 1, wherein a time during which the wiping blade is soaked in the detergent in the second cleaning portion is set to be longer than a time during which the wiping blade is soaked in the detergent in the first cleaning portion.

5. The wiping unit according to claim 4, wherein a distance by which the wiping blade moves in the cleaning tank in the second cleaning portion is set to be longer than a distance by which the wiping blade moves in the cleaning tank in the first cleaning portion.

6. The wiping unit according to claim 1, wherein the blade wiping member is placed so as to come into contact with the detergent filled in the cleaning tank in the first cleaning portion and the second cleaning portion.

7. The wiping unit according to claim 6, wherein the cleaning tank of at least one of the first cleaning portion and the second cleaning portion has ribs provided in a depth direction, and the ribs have an index portion at a height of a liquid surface when the cleaning tank is filled with a required amount of the detergent.

8. An inkjet printer comprising the wiping unit according to claim 1.

* * * * *